US005630237A

United States Patent [19]

Ku

[11] Patent Number: 5,630,237

[45] Date of Patent: May 20, 1997

[54] FOAM FILLED INFLATABLE MAT WITH A PERIPHERAL AIR DUCT

[76] Inventor: Tun-Jen Ku, 16,Kuo Chung 2nd Rd., Da-Li City, Taichung Hsien, Taiwan

[21] Appl. No.: 627,043

[22] Filed: Apr. 3, 1996

[51] Int. Cl.[6] ..... A47C 27/18; A47C 27/08

[52] U.S. Cl. ..... 5/420; 5/709

[58] Field of Search ..... 5/709, 706, 420, 5/413 AM, 655.9, 655.3

[56] References Cited

U.S. PATENT DOCUMENTS

| | | | |
|---|---|---|---|
| 1,576,211 | 3/1926 | O'Kane | 5/710 |
| 3,798,686 | 3/1974 | Gaiser | 5/413 AM |
| 5,142,717 | 9/1992 | Everard et al. | 5/709 |

*Primary Examiner*—Alexander Grosz
*Attorney, Agent, or Firm*—Bacon & Thomas

[57] ABSTRACT

An inflatable mat has an upper fabric layer, a lower fabric layer, an airtight space formed between the upper fabric layer and the lower fabric layer, an inflation valve and an air duct located on the periphery of the airtight space such that the air duct is in communication with the inflation valve. The airtight space is provided with foam attached to the upper fabric layer and the lower fabric layer. The inflatable mat is inflated by injecting air via the inflation valve into the air duct through which the air is dispersed rapidly and uniformly into the airtight space. The inflated mat can be deflated so as to enable the mat to be folded for storage or shipment.

3 Claims, 5 Drawing Sheets

FOAM FILLED INFLATABLE MAT WITH A PERIPHERAL AIR DUCT

FIELD OF THE INVENTION

The present invention relates generally to a mat, and more particularly to an inflatable mat.

BACKGROUND OF THE INVENTION

As illustrated in FIG. 1, a prior art mat 10 comprises an upper fabric layer 12, a lower fabric layer 12', an airtight space formed between the upper fabric layer 12 and the lower fabric layer 12', and an inflation valve 13 attached to one end of the mat 10 such that the inflation valve 13 is in communication with the airtight space. The upper fabric layer 12 and the lower fabric layer 12' are provided respectively on the inner sides thereof with a foam material 11 attached thereto.

The mat 10 can be inflated by injecting air into the airtight space via the inflation valve 13. The inflated mat 10 can be used for absorbing shock or providing a cushioning effect.

Such a prior art mat as described above is defective in design in that the mat cannot be inflated or deflated rapidly because of the obstruction of the air passage by the foam fabric, and that the injected air cannot be dispersed quickly and evenly throughout the airtight space. Further, the inflated mat is devoid of an anchoring device to prevent it from drifting.

SUMMARY OF THE INVENTION

It is therefore the primary objective of the present invention to provide an inflatable mat with an air duct and an inflation valve in communication with the air duct to facilitate the inflating and deflating of the inflatable mat easily and quickly.

It is another objective of the present invention to provide an inflatable mat with an anchoring device to prevent the inflatable mat from drifting when the inflatable mat is inflated and located.

The features and the advantages of the present invention will be more readily understood upon a thoughtful deliberation of the following detailed description of a preferred embodiment of the present invention in conjunction with the accompanying drawings.

DETAILED DESCRIPTION OF THE EMBODIMENT

Figure 1A:
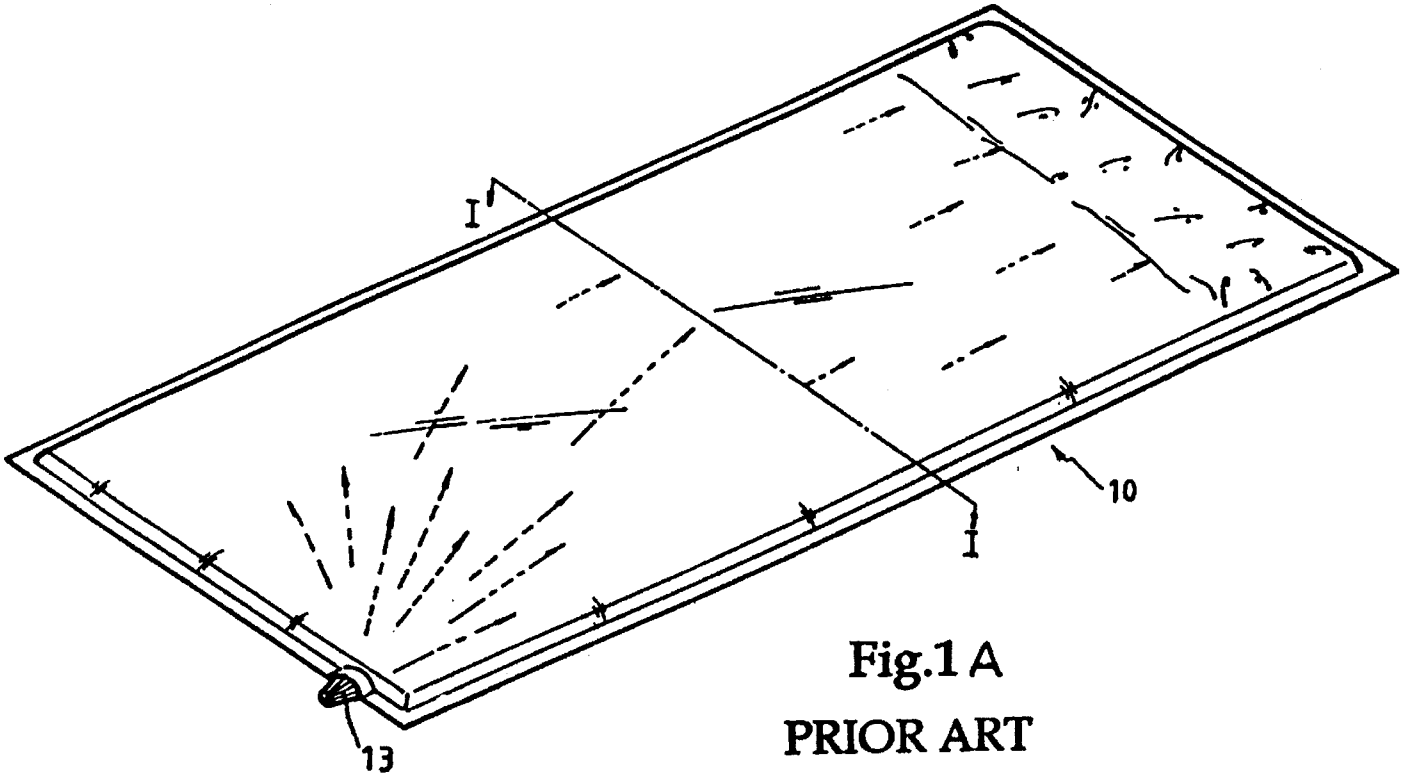
Fig.1A PRIOR ART
FIG. 1A is a perspective view of an inflatable mat of the prior art.
Figure 1B:
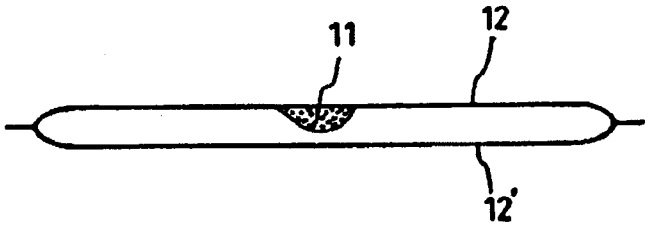
Fig.1B PRIOR ART
FIG. 1B is a cross-section taken along line I—I of FIG. 1A.
Figure 2:
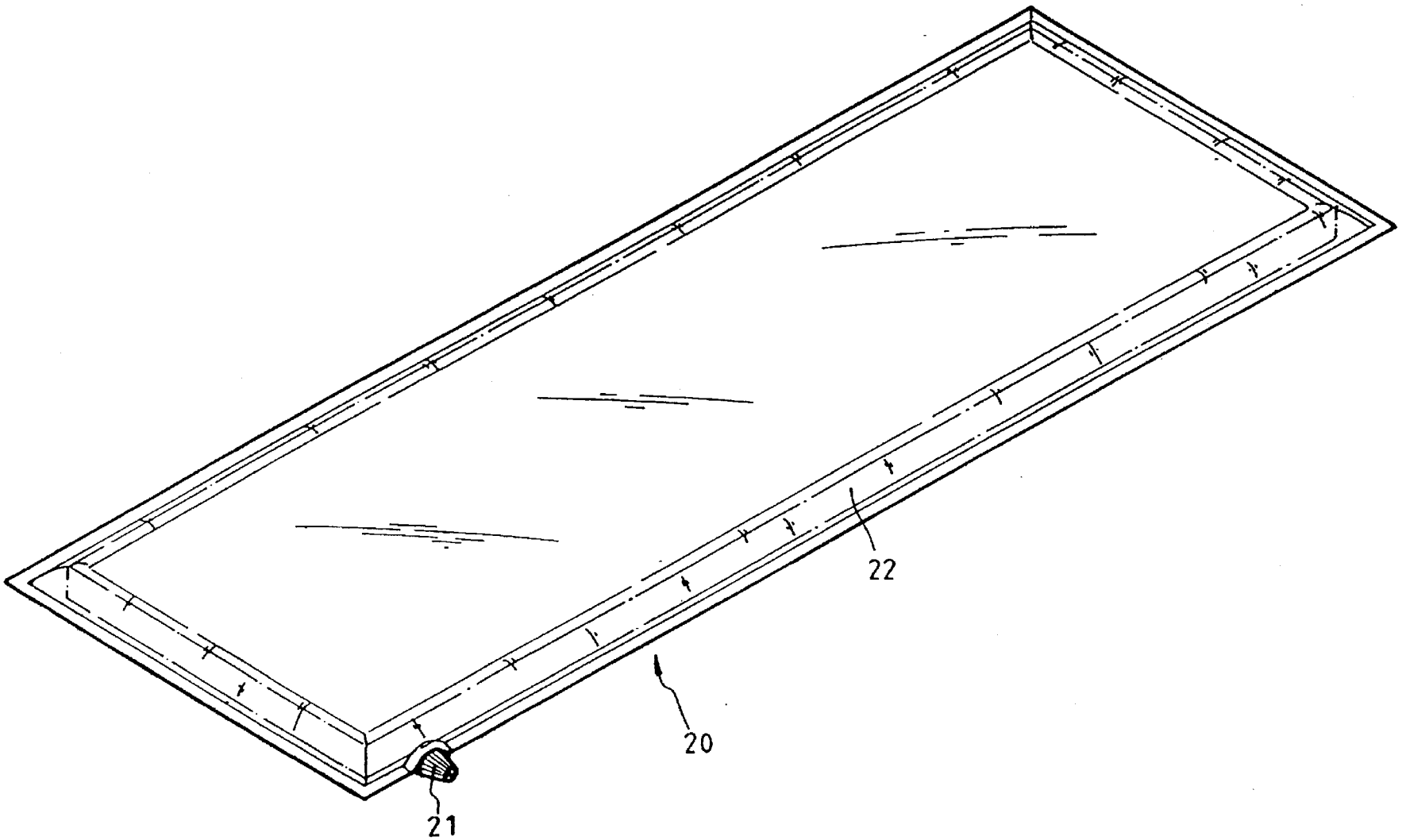
FIG. 2 is a perspective view of an inflatable mat of the present invention.
Figure 3:
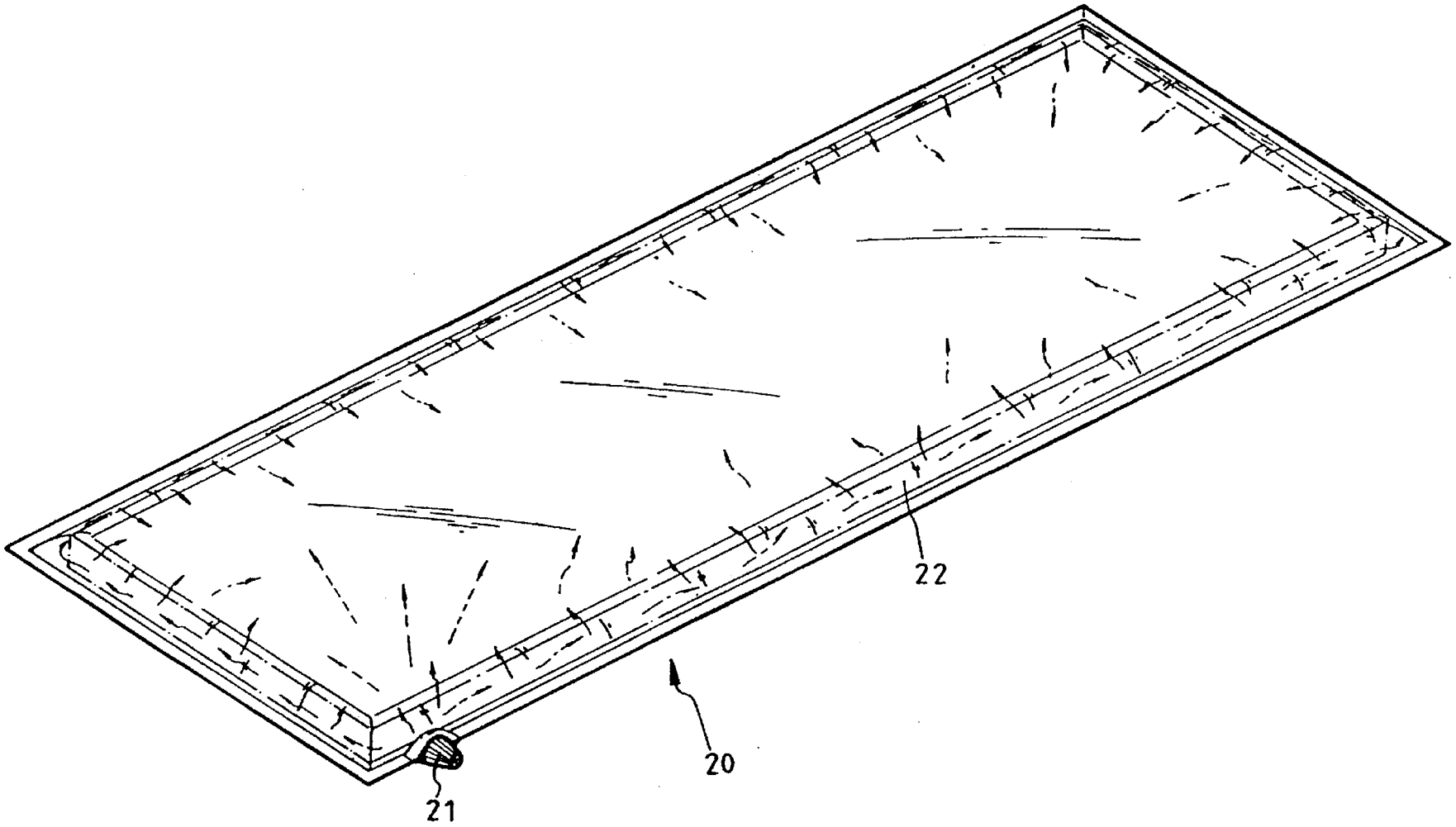
FIG. 3 is a schematic view of the inflatable mat of the present invention.

As shown in FIGS. 2–5, an inflatable mat 20 embodied in the present invention is composed of an upper fabric layer 23, a lower fabric layer 23', an airtight space formed between the upper fabric layer 23 and the lower fabric layer 23', an inflation valve 21 attached to one end of the mat 20, and an air duct 22 located on the periphery of the airtight space such that the air duct 22 is in communication with the inflation valve 21. The upper fabric layer 23 and the lower fabric layer 23' are provided respectively on the inner side thereof with a foam material 23 attached thereto.

The inflatable mat 20 of the present invention can be inflated rapidly and uniformly via the inflation valve 21 and the air duct 22. The air is pumped into the air duct 22 via the inflation valve 21. As the air duct 22 is previous to air, the injected air is quickly dispersed through the air duct 22 into the airtight space. The inflated mat 20 can be used for absorbing shock or for providing a cushioning effect.

Since the injected air is dispersed into the airtight pace via the air duct 22 which is located on the periphery of the airtight space of the mat 20, the obstruction of the foam material 24 to the passage of air is kept to a minimum. As a result, the mat 20 of the present invention can be inflated rapidly and evenly.

Figure 5A:
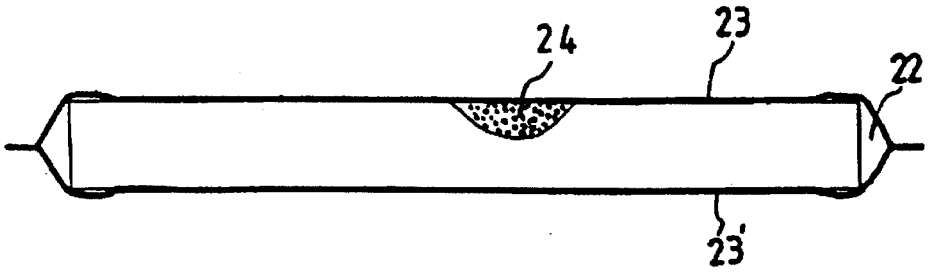
FIGS. 5A and 5B are schematic views illustrating the inflating process of the inflatable mat of the present invention.
Figure 5B:
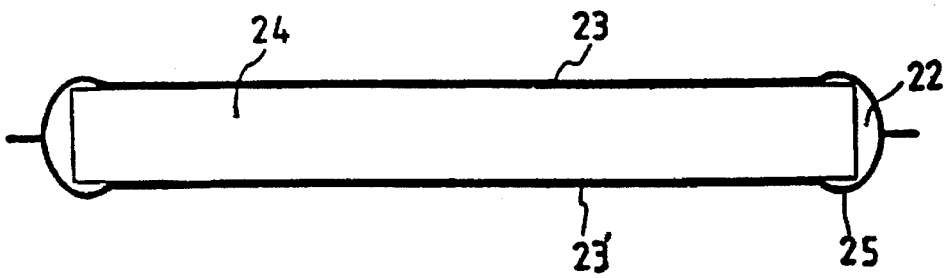
Figure 6:
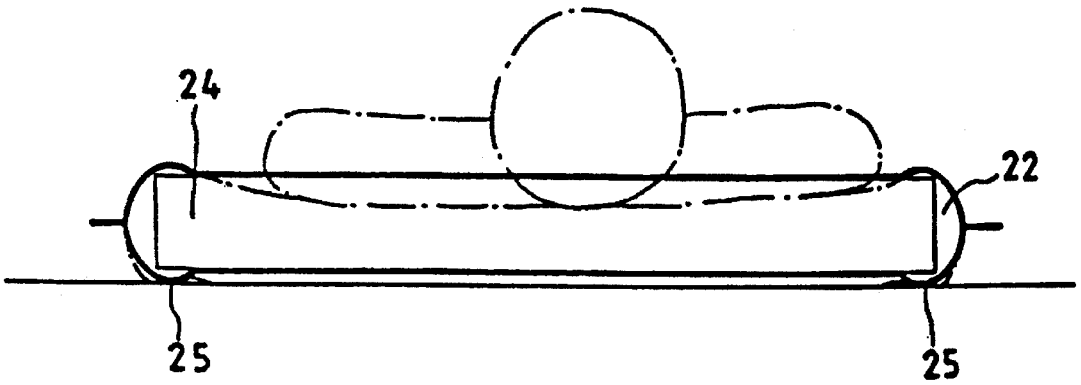
FIG. 6 is a schematic view of the present invention in use.

After the mat 20 of the present invention is properly inflated, the air duct 22 is also inflated to become a support rib 25 serving to provide the mat 20 with an anchoring effect, so as to prevent the inflated mat 20 from drifting, as illustrated in FIGS. 5 and 6.

Figure 4:
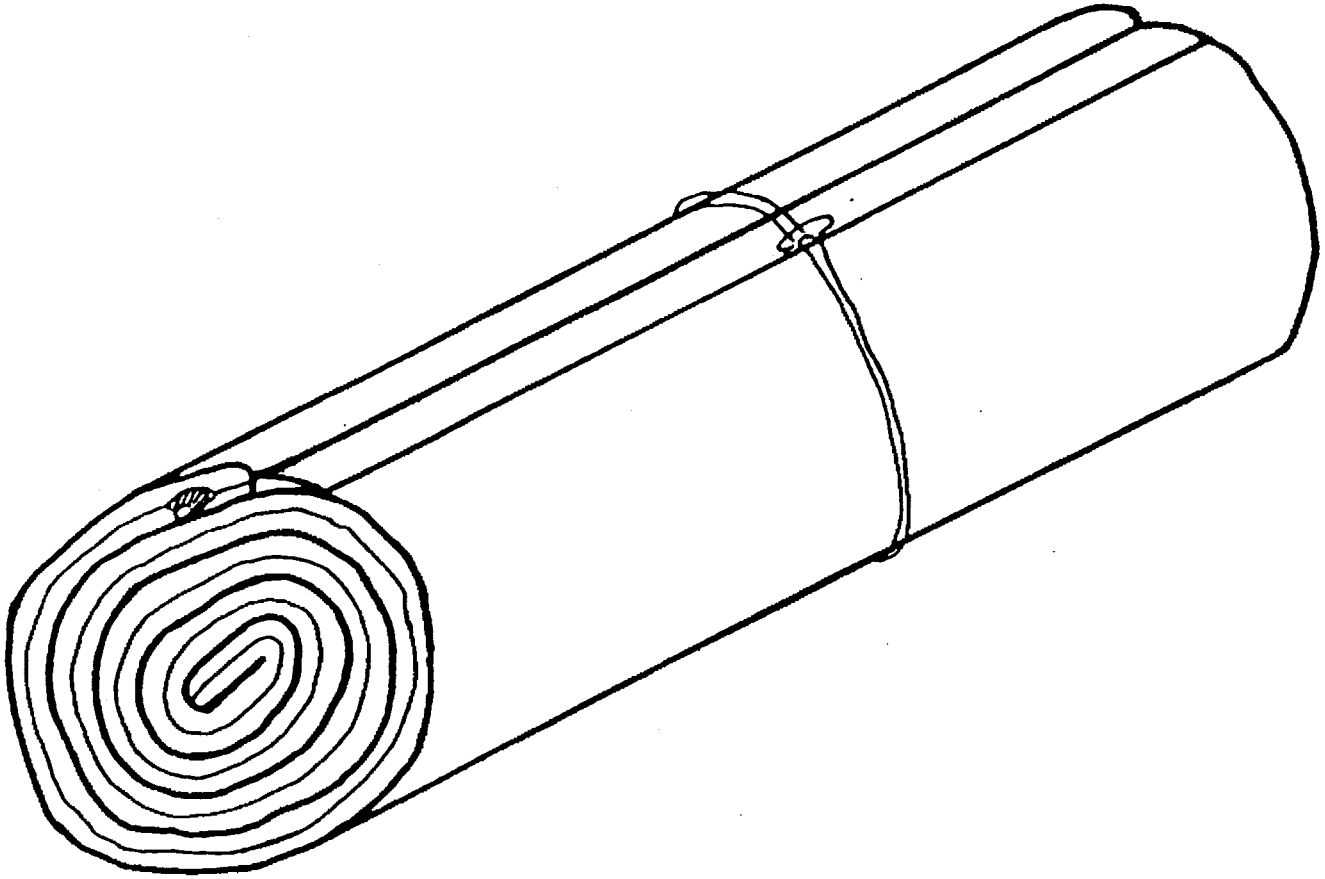
FIG. 4 is a perspective view showing the inflatable mat of the present invention folded.

The inflated mat 20 of the present invention can be deflated and then folded, as shown in FIG. 4. The air in the airtight space of the mat 20 of the present invention can be let out via the air duct 22 and the inflation valve 21.

It must be noted here that the upper fabric layer 23 and the lower fabric layer 23' of the mat 20 of the present invention are made of a fabric material impermeable to water and air.

The embodiment of the present invention described above is to be regarded in all respect as being merely illustrative and not restrictive. Accordingly, the present invention may be embodied in other specific forms without deviating from the spirit thereof. The present invention is therefore to be limited only by the scope of the following appended claim.

What is claimed is:

1. An inflatable mat comprising:

an upper fabric layer made of a fabric material impermeable to water and air, and provided on an inner side thereof with a foam material attached thereto;

a lower fabric layer made of a fabric material impermeable to water and air, and provided on an inner side thereof with a foam material attached thereto, the lower fabric layer attached to the upper fabric layer so as to form an airtight space between said upper fabric layer and said lower fabric layer, said airtight space is provided in a periphery thereof with an air duct which is previous to air, wherein said air duct is capable of being inflated by air to become a support rib extending above, to the sides and below the foam material to serve as an anchoring means to prevent said lower fabric layer from drifting when said lower fabric layer is in contact with a floor or ground surface; and an inflation valve attached to one of said upper fabric layer and said lower fabric layer and in communication with said air duct.

2. The inflatable mat as defined in claim 1, wherein said airtight space can be deflated via said inflation valve after said airtight space is inflated via said inflation valve.

3. The inflatable mat as defined in claim 2, wherein said upper fabric layer and said lower fabric layer can be folded after said airtight space is deflated.

* * * * *